US011374307B2

(12) United States Patent
Nasu

(10) Patent No.: US 11,374,307 B2
(45) Date of Patent: Jun. 28, 2022

(54) ANTENNA DEVICE AND COMMUNICATION TERMINAL APPARATUS

(71) Applicant: Murata Manufacturing Co., Ltd., Nagaokakyo (JP)

(72) Inventor: Takafumi Nasu, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 133 days.

(21) Appl. No.: 16/992,197

(22) Filed: Aug. 13, 2020

(65) Prior Publication Data

US 2020/0373650 A1 Nov. 26, 2020

Related U.S. Application Data

(63) Continuation of application No. PCT/JP2019/012058, filed on Mar. 22, 2019.

(30) Foreign Application Priority Data

Apr. 25, 2018 (JP) ..... JP2018-084210

(51) Int. Cl.
*H01Q 1/24* (2006.01)
*H01Q 5/378* (2015.01)
(Continued)

(52) U.S. Cl.
CPC ..... *H01Q 1/243* (2013.01); *H01Q 1/38* (2013.01); *H01Q 1/50* (2013.01); *H01Q 5/378* (2015.01); *H01Q 21/30* (2013.01)

(58) Field of Classification Search
CPC ..... H01Q 1/243; H01Q 5/378; H01Q 1/38
(Continued)

(56) References Cited

U.S. PATENT DOCUMENTS 9,502,765 B2 * 11/2016 Boutayeb ..... H01Q 3/24
10,389,015 B1 * 8/2019 Judd ..... H01Q 5/392
(Continued)

FOREIGN PATENT DOCUMENTS

JP 2014-053808 A 3/2014
JP 5505561 B2 5/2014
(Continued)

OTHER PUBLICATIONS ip.com search.*
Official Communication issued in International Patent Application No. PCT/JP2019/012058, dated Jun. 4, 2019.

*Primary Examiner* — Allyson N Trail
(74) *Attorney, Agent, or Firm* — Keating & Bennett, LLP

(57) ABSTRACT

An antenna device includes first and second radiating elements, a first coil coupled to the first radiating element or a feeding circuit, and a second coil coupled to the second radiating element and coupled to the first coil via an electromagnetic field. The first and second radiating elements are coupled to each other via an electric field. At a resonant frequency defined by the antenna coupling element and the second radiating element, the absolute value of the phase difference between a current flowing into the second radiating element due to the electromagnetic field of the first coil and the second coil and a current flowing into the second radiating element due to the electric field is equal to or less than about 90 degrees.

15 Claims, 5 Drawing Sheets

(51) Int. Cl.
*H01Q 1/38* (2006.01)
*H01Q 1/50* (2006.01)
*H01Q 21/30* (2006.01)

(58) Field of Classification Search
USPC ..... 235/492
See application file for complete search history.

(56) References Cited

U.S. PATENT DOCUMENTS

| | | | | |
|---|---|---|---|---|
| 2010/0259457 | A1* | 10/2010 | Friman | H01Q 7/00 343/745 |
| 2014/0049440 | A1 | 2/2014 | Ueki et al. | |
| 2014/0218246 | A1 | 8/2014 | Ishizuka et al. | |
| 2016/0126623 | A1* | 5/2016 | Maxim | H01L 23/367 343/860 |
| 2016/0146743 | A1* | 5/2016 | Edward | G01F 1/582 73/61.45 |
| 2017/0117638 | A1* | 4/2017 | Kim | H01Q 21/08 |
| 2019/0296446 | A1* | 9/2019 | Tseng | H01Q 5/371 |

FOREIGN PATENT DOCUMENTS

| | | | |
|---|---|---|---|
| JP | 5505581 | B1 | 5/2014 |
| WO | 2015/182340 | A1 | 12/2015 |

* cited by examiner

ANTENNA DEVICE AND COMMUNICATION TERMINAL APPARATUS

CROSS REFERENCE TO RELATED APPLICATIONS

This application claims the benefit of priority to Japanese Patent Application No. 2018-084210 filed on Apr. 25, 2018 and is a Continuation Application of PCT Application No. PCT/JP2019/012058 filed on Mar. 22, 2019. The entire contents of each application are hereby incorporated herein by reference.

BACKGROUND OF THE INVENTION

1. Field of the Invention

The present invention relates to an antenna device including an antenna coupling element coupled between a plurality of radiating elements and a feeding circuit and also relates to a communication terminal apparatus.

2. Description of the Related Art

In order to widen the usable frequency range of antenna device or to support a plurality of frequency ranges, an antenna device including two radiating elements directly or indirectly coupled to each other is used. Japanese Patent No. 5505561 discloses an antenna device including two radiating elements and an antenna coupling element that controls power feeding for the two radiating elements.

For example, some communication antennas for mobile phones cover a wide frequency range such as 0.6 GHz to 2.7 GHz. Moreover, for the purpose of implementing carrier aggregation, in which the transmission rate is increased by using a plurality of frequency ranges together, there is a demand for an antenna device that can use a wide range of frequencies together.

The antenna device disclosed in Japanese Patent No. 5505561 is formed by coupling an antenna coupling element, which is configured to implement a transformer, between two radiating elements (a feeding radiating element and a parasitic radiating element) and a feeding circuit. The antenna device having this configuration is very useful in covering a wide range of frequencies together.

However, as functions of communication terminal apparatuses including antenna devices are enhanced, the antenna space is accordingly decreased, and as a result, the feeding radiating element and the parasitic radiating element are arranged close to each other. This arrangement strengthens electric field coupling between the feeding radiating element and the parasitic radiating element.

Such a condition causes a problem in which sufficient radiation efficiency cannot be obtained when the current flowing through the parasitic radiating element due to the antenna coupling element and the current flowing through the parasitic radiating element due to the electric field coupling weaken each other.

When the amount of current flowing through the parasitic radiating element is less than the amount of current that should flow through the parasitic radiating element as described above, the radiation efficiency of the parasitic radiating element is lowered.

SUMMARY OF THE INVENTION

Preferred embodiments of the present invention provide antenna devices and communication terminal apparatuses in each of which, in a condition that direct coupling and indirect coupling via an antenna coupling element exist between two radiating elements, a decrease in the radiation efficiency due to currents flowing into a radiating element and canceling each other out is significantly reduced or prevented.

An antenna device according to a preferred embodiment of the present disclosure includes a first radiating element, a second radiating element, a first coil coupled to one of the first radiating element and a feeding circuit, and a second coil coupled to the second radiating element and coupled to the first coil via an electromagnetic field. The first radiating element and the second radiating element are coupled to each other via an electric field. Additionally, the first coil and the second coil define an antenna coupling element. According to a determined direction of coupling between the first coil and the second coil, at a resonant frequency generated by the antenna coupling element and the second radiating element, the absolute value of the phase difference between a current flowing into the second radiating element due to the electromagnetic field of the first coil and the second coil and a current flowing into the second radiating element due to the electric field of the first radiating element and the second radiating element is equal to or less than about 90 degrees.

With the features described above, the current flowing into the second radiating element due to electromagnetic field coupling between the first coil and the second coil and the current flowing into the second radiating element due to electric field coupling between the first radiating element and the second radiating element do not cancel each other.

The preferred embodiments of the present invention provide antenna devices and communication terminal apparatuses in each of which, in a condition that direct coupling due to parasitic capacitance and indirect coupling via an antenna coupling element exist between two radiating elements, a decrease in the radiation efficiency due to currents flowing into the radiating element and canceling each other is significantly reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
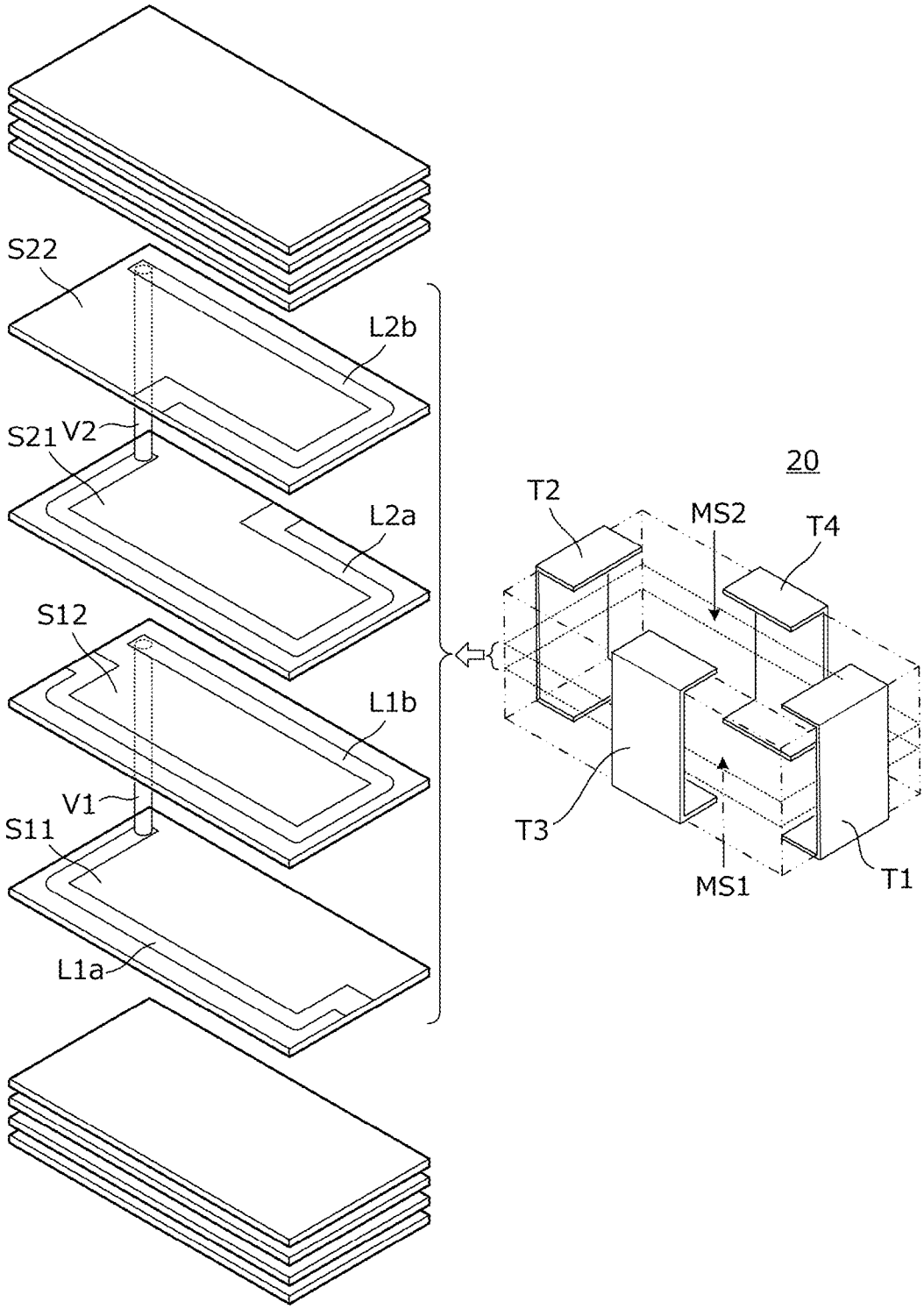
FIG. 1 is a perspective view of an antenna coupling element used in an antenna device and a communication terminal apparatus according to a preferred embodiment of the present invention and an exploded perspective view of a portion of the antenna coupling element.

FIG. 1 is a perspective view of an antenna coupling element 20 used in an antenna device and a communication terminal apparatus according to a preferred embodiment of the present invention and an exploded perspective view of a portion of the antenna coupling element 20. The antenna coupling element 20 of the present preferred embodiment is a parallelepiped or substantially parallelepiped chip component mounted at a circuit board in a communication terminal apparatus. FIG. 1 separately shows the outer shape and the internal structure of the antenna coupling element 20. A first radiating element connection terminal T1, a feeding circuit connection terminal T2, a ground connection terminal T3, and a second radiating element connection terminal T4 are provided at the outer surface of the antenna coupling element 20. The antenna coupling element 20 includes a first surface MS1 and a second surface MS2 that is a surface opposite to the first surface MS1. In the present preferred embodiment, the first surface MS1 or the second surface MS2 is the mounting surface.

Conductor patterns L1*a*, L1*b*, L2*a*, and L2*b* are provided inside the antenna coupling element 20. The conductor pattern L1*a* and the conductor pattern Lib are coupled to each other via an interlayer connection conductor V1. The conductor pattern L2*a* and the conductor pattern L2*b* are coupled to each other via an interlayer connection conductor V2. In FIG. 1, insulating base layers S11, S12, S21 and S22 on which the respective conductor patterns are provided are shown separately in the stacking direction.

When the antenna coupling element 20 is provided by a resin multilayer substrate, the insulating base layer is preferably, for example, a liquid crystal polymer (LCP) sheet, and the conductor patterns L1*a*, L1*b*, L2*a*, and L2*b* are preferable provided by, for example, patterning copper foils. When the antenna coupling element 20 is provided by a ceramic multilayer substrate, the insulating base layer is preferably made of, for example, low temperature co-fired ceramics (LTCC), and the conductor patterns L1*a*, L1*b*, L2*a*, and L2*b* are preferably formed by, for example, applying a copper paste.

Since the base layer is made of a non-magnetic material (not made of a magnetic ferrite), the antenna coupling element 20 is able to define a transformer have a predetermined inductance and a coupling coefficient in a high frequency range of about 0.6 GHz to about 2.7 GHz, for example.

The conductor patterns L1*a*, L1*b*, L2*a*, and L2*b* are provided centrally in the middle layer of the multilayer body, and as a result, there is an interval between a ground conductor at the circuit board and a first coil L1 and a second coil L2 in the state in which the antenna coupling element 20 is mounted at the circuit board. Further, if a metal component or element approaches the upper portion of the antenna coupling element 20, an interval still exists between this metal component or element and the first coil L1 and the second coil L2. As a result, the magnetic field of the first coil L1 and the second coil L2 described later is less likely to be affected by the outside environment and stable characteristics are able to be provided.

Figure 2:
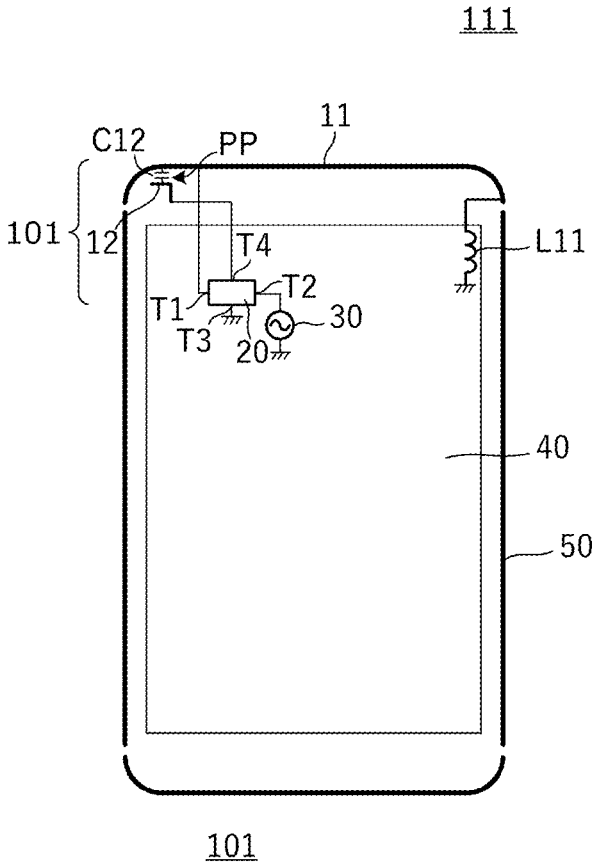
FIG. 2 is a plan view of an antenna device and a communication terminal apparatus including an antenna device according to a preferred embodiment of the present invention.

FIG. 2 is a plan view of an antenna device 101 and a communication terminal apparatus 111 including the antenna device 101. The communication terminal apparatus 111 includes a first radiating element 11, a second radiating element 12, a circuit board 40, a resin portion at which the radiating element is provided, and a housing 50.

A feeding circuit 30 is provided at the circuit board 40. Additionally, the antenna coupling element 20 and an inductor L11 are mounted at the circuit board 40.

The first radiating element 11, the second radiating element 12, and the circuit board 40 are enclosed by the housing 50, which has conductivity, when viewed in plan view. The first radiating element 11 is provided at a portion of the housing 50. This portion of the housing is configured to be electrically separated from the other portion of the housing 50. The second radiating element 12 is provided as a conductor pattern at the resin portion in the housing 50 by using the laser-direct-structuring (LDS) process, for example. The second radiating element 12 is not limited to this example and may be provided as a conductor pattern at, for example, a flexible printed circuit (FPC) by using a photoresist process, for example.

The first radiating element connection terminal T1 of the antenna coupling element 20 is coupled to the first radiating element 11 and the second radiating element connection terminal T4 is coupled to the second radiating element 12. The feeding circuit connection terminal T2 is coupled to the feeding circuit 30 and the ground connection terminal T3 is coupled to a ground conductor pattern. With the features described above, the first coil and the second coil of the antenna coupling element 20 shown in FIG. 1 provide a direction of the magnetic field created by the first coil when a current flows from the first coil to the first radiating element that is identical or substantially identical to a direction of the magnetic field created by the second coil when a current flows from the second coil to the second radiating element.

The inductor L11 is coupled between one end of the first radiating element 11 and ground.

The first radiating element 11 operates as a loop antenna in conjunction with the inductor L11 and the ground conductor pattern provided at the circuit board. The second radiating element 12 operates as a monopole antenna.

A parasitic capacitance C12 between radiating elements is generated at a portion PP between a portion of the first radiating element 11 and a portion of the second radiating element 12. In the example shown in FIG. 2, the portion of the first radiating element 11 and the portion of the second radiating element 12 including an end portion of the second radiating element 12 are positioned in parallel or substantially in parallel with each other at the portion PP, where the parasitic capacitance C12 is particularly generated. The first radiating element 11 and the second radiating element 12 are coupled to each other via an electric field by this parasitic capacitance C12. Accordingly, the portion of the first radiating element 11 and the end portion of the second radiating element 12 are particularly strongly coupled to each other via an electric field. It should be noted that, as an incidental effect, the first radiating element 11 and the second radiating element 12 may be coupled to each other via a magnetic field.

As shown in FIG. 2, when the loop antenna includes the first radiating element 11, the space for the first radiating element 11 is able to be significantly reduced. Furthermore, with the loop antenna structure, changes in antenna characteristics of the first radiating element 11 due to the proximity of the human body are able to be significantly reduced or prevented. Further, by positioning the second radiating element 12 having a monopole structure inside the structure with respect to the loop antenna, changes in antenna characteristics of the second radiating element due to the proximity of the human body are able to be significantly reduced or prevented.

Figure 3:
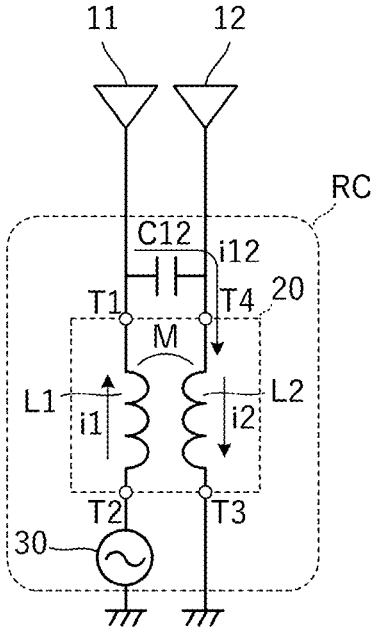
FIG. 3 is a circuit diagram of the antenna device including the antenna coupling element.

FIG. 3 is a circuit diagram of the antenna device 101 including the antenna coupling element 20. The antenna coupling element 20 includes the first coil L1 and the second coil L2 that are coupled to each other via an electromagnetic field.

The first radiating element 11 resonates in a frequency range of a low band (for example, about 0.60 GHz to about 0.96 GHz). The first radiating element 11 to which the first coil L1 is coupled supports at least a low band. A resonant frequency included in such a low band is a "first resonant frequency". Additionally, the first radiating element resonates in a frequency range of a high band (for example, about 1.71 GHz to about 2.69 GHz) that is a frequency range higher than the low band. For example, in the case in which the fundamental resonant frequency of the first radiating element 11 to which the first coil L1 is coupled exists in the low band and its third harmonic resonant frequency exists in the high band, the first radiating element 11 resonates in both the low band and the high band.

The second radiating element 12 resonates with the antenna coupling element 20 in the frequency range of the high band (for example, about 1.71 GHz to about 2.69 GHz). The resonant frequency in this case is a "second resonant frequency", for example, about 2.3 GHz. The second radiating element 12 supports a high band and widens the high band. Thus, the fundamental resonant frequency of the first radiating element to which at least the first coil L1 is coupled is lower than the fundamental resonant frequency of the second radiating element 12 and the antenna coupling element.

The first radiating element 11 is fed with power from the feeding circuit 30 through the first coil L1. The second radiating element 12 is fed with power from the second coil L2 (power is supplied with an induced electromotive force in the second coil L2). For example, when a current 11 flows in the first coil L1, a current i2 is induced in the second coil L2, and as a result, the second radiating element 12 is fed (driven) with power supplied with the current i2. In addition, the second radiating element 12 is coupled to the first radiating element 11 via an electric field by the parasitic capacitance C12. Due to this electric field coupling, a current i12 flows toward the second radiating element 12 side.

As shown in FIG. 3, the parasitic capacitance C12 between the first radiating element 11 and the second radiating element 12, the first coil L1, and the second coil L2 define a resonance circuit RC; in other words, the resonance circuit RC is parasitically created by coupling the antenna coupling element 20 to the first radiating element 11 and the second radiating element 12 that are coupled to each other via an electric field. When the resonant frequency of this resonance circuit RC is in a vicinity of the second resonant frequency described above, the direction of the current flowing through the second coil L2 and the current flowing into the second radiating element 12 in a frequency range (the high band) of the second resonant frequency is important as described below.

The polarity of the coupling between the first coil L1 and the second coil L2 is determined such that the current i2 and the current i12 do not weaken each other at the second resonant frequency described above. In other words, the first coil L1 and the second coil L2 are coupled to each other such that, at the second resonant frequency defined by the second radiating element 12 and the antenna coupling element 20 defined by the first coil L1 and the second coil L2, the absolute value of the phase difference between the current i12 flowing into the second radiating element 12 due to electromagnetic field coupling between the first coil L1 and the second coil L2 and the current i2 flowing into the second radiating element 12 due to electric field coupling is equal to or less than about 90 degrees.

As a result, the relationship between the direction of the magnetic field created by the first coil L1 when a current flows from the first coil L1 to the first radiating element 11 and the direction of the magnetic field created by the second coil L2 when a current flows from the second coil L2 to the second radiating element 12 is changed between the equal or substantially equal relationship and the opposite or substantially opposite relationship in accordance with the position of electric field coupling in the antenna, but the coupling relationship described above is not changed. For example, depending on the position of electric field coupling in the antenna, in the antenna coupling element 20, the terminal T3 may be a second radiating element connection terminal and the terminal T4 may be a ground connection terminal. Accordingly, the first coil L1 and the second coil L2 provide a direction of the magnetic field created by the first coil L1 when a current flows from the first coil L1 to the first radiating element 11 that is opposite or substantially opposite to a direction of the magnetic field created by the second coil L2 when a current flows from the second coil L2 to the second radiating element 12.

Due to the relationship described above, the current i12 and the current i2 do not weaken each other, and thus, the radiation efficiency in the high band is significantly improved. Furthermore, in the case in which the absolute value of the phase difference between the current i12 and the current i2 is less than about 90 degrees, the currents strengthen each other, and thus, the radiation efficiency in the high band is further significantly improved.

Figure 4:
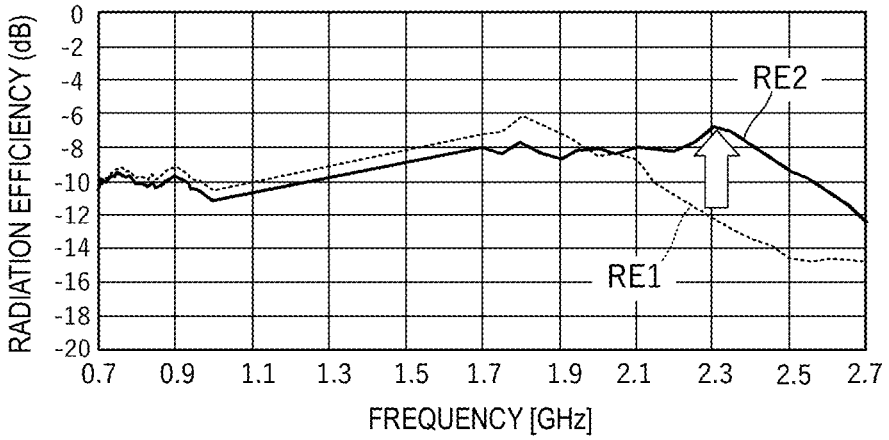
FIG. 4 shows frequency characteristics with respect to the radiation efficiency of the antenna device.

FIG. 4 shows the frequency characteristic with respect to the radiation efficiency of the antenna device 101. In FIG. 4, RE1 is the radiation efficiency of an antenna device of a comparative example and RE2 is the radiation efficiency of the antenna device 101 of the present preferred embodiment.

The polarity of coupling between the first coil L1 and the second coil L2 of the antenna coupling element 20 of the antenna device of the comparative example is opposite or substantially opposite to the polarity of the coupling between the first coil L1 and the second coil L2 of the antenna coupling element 20 included in the antenna device 101 according to the present preferred embodiment. In the antenna device of the comparative example, as shown in FIG. 3, the absolute value of the phase difference between the current i12 flowing into the second radiating element 12 due to electromagnetic field coupling between the first coil L1 and the second coil L2 and the current i2 flowing into the second radiating element 12 due to electric field coupling exceeds about 90 degrees and the current i12 and the current i2 weaken each other.

In the present preferred embodiment, as seen from FIG. 4, in the frequency range of about 0.6 GHz to about 2.0 GHz, the radiation efficiency of the antenna device of the present preferred embodiment is equal or substantially equal to the radiation efficiency of the antenna device of the comparative example, but at about 2.0 GHz or higher, the antenna device 101 of the present preferred embodiment indicates higher radiation efficiency. This is because, in this frequency range, the current i12 and the current i2 weaken each other in the antenna device of the comparative example, and in the antenna device of the present preferred embodiment the current i12 and the current i2 do not weaken each other but rather strengthen each other by being added to each other.

By using the electromagnetic field coupling described above, the phase of the current i12 flowing into the second radiating element 12 is able to be determined by measuring, for example, with the use of a network analyzer or the like, the phase of the current flowing between the second radiating element and the second coil L2 at the second resonant frequency in the state in which the first radiating element 11 and the second radiating element 12 are physically sufficiently spaced apart from each other in the structure of the antenna device 101 as shown in FIG. 2. However, it is in practice difficult to directly measure the phase of the current without bringing a current probe adjacent to or in a vicinity of the object. Accordingly, the phase of the current i12 is determined, for example, as follows: firstly, 2×2 S (Scattering) parameters of two input ends, which are an input end of the first radiating element 11 (an end on the power supply side of the first radiating element 11) and an input end of the second radiating element 12 (an end on the ground side of the second radiating element 12), are measured and 4×4 S parameters of only the antenna coupling element 20 having four terminals of the terminals T1 to T4 are also measured; and subsequently, by including the circuitry of the antenna device 101 and the S parameters described above, the current flowing between the second radiating element 12 and the second coil L2 is determined by performing a calculation on a circuit simulator. Furthermore, for example, the structure of the antenna device 101 as shown in FIG. 2 is changed so that the antenna coupling element 20 is removed. Accordingly, the phase of the current i2 flowing into the second radiating element 12 due to electric field coupling is determined by measuring the phase of the current flowing across the second radiating element 12 and ground at the second resonant frequency by a network analyzer or the like. Also in this case, for example, 2×2 S parameters of two inputs of the input end of the first radiating element 11 and the input end of the second radiating element 12 are measured; and subsequently, by including the circuitry of the antenna device 101 in which the coupling element is removed and the 2×2 S parameters, the current flowing between the second radiating element 12 and ground is determined by performing a calculation on a circuit simulator.

The feeding circuit 30 shown in FIGS. 2 and 3 inputs and outputs communication signals in the low band including the resonant frequency of the first radiating element 11 and communication signals in the high band including the resonant frequency of the antenna coupling element 20 and the second radiating element 12. As a result, a communication terminal apparatus that handles broadband communication signals is able to be provided.

Next, an example is described in which, regardless of the polarity of coupling between the first coil L1 and the second coil L2 of the antenna coupling element 20, the current i12 flowing into the second radiating element 12 due to electromagnetic field coupling between the first coil L1 and the second coil L2 and the current i2 flowing into the second radiating element 12 due to electric field coupling do not weaken each other at the second resonant frequency.

Figure 5A:
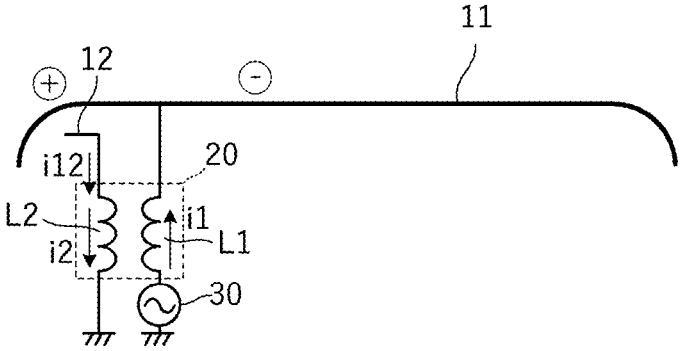
FIGS. 5A and 5B each show an antenna device according to a preferred embodiment of the present invention.
Figure 5B:
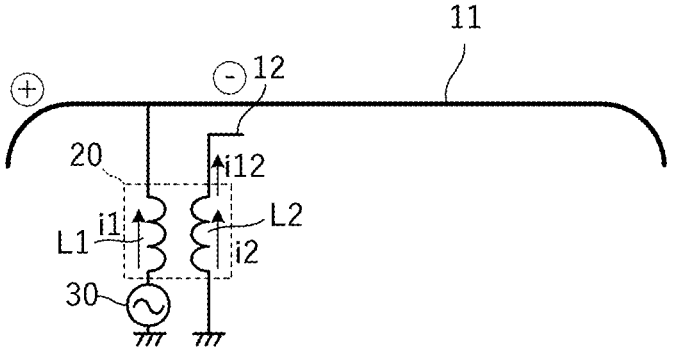

FIGS. 5A and 5B each show an antenna device according to a preferred embodiment of the present invention. The antenna device shown in FIGS. 5A and 5B both include the first radiating element 11, the second radiating element 12, and the antenna coupling element 20. The first radiating element 11 and the second radiating element 12 are both monopole radiating elements.

The antenna devices shown in FIGS. 5A and 5B are identical or substantially identical to each other with respect to the feed point of the first radiating element 11 but different from each other in the close position with respect to the second radiating element 12. Specifically, in FIGS. 5A and 5B, the second radiating element 12 is coupled via an electric field to different positions of the first radiating element 11; the positions differ from each other in the polarity of potential in the first radiating element 11.

Thus, under the condition that the current i12 flowing into the second radiating element 12 due to electromagnetic field coupling between the first coil L1 and the second coil L2 and the current i2 flowing into the second radiating element 12 due to electric field coupling do not cancel each other out at the second resonant frequency, the antenna coupling element 20 shown in FIG. 5A and the antenna coupling element 20 shown in FIG. 5B are opposite or substantially opposite to each other with respect to the polarity of coupling between the first coil L1 and the second coil L2.

Two kinds of the antenna coupling elements 20 that are different from each other with respect to the polarity of coupling between the first coil L1 and the second coil L2 are previously prepared and one antenna coupling element 20 of a predetermined polarity of coupling may be used in accordance with the condition to which the antenna coupling element 20 is applied. Alternatively, in the example shown in FIG. 1, the polarity of coupling is able to be determined by selecting between the top surface and the lower surface of the antenna coupling element 20 as a mounting surface.

Next, some examples of an antenna device including features of individual portions different from those of the antenna devices described above will be provided.

Figure 6:
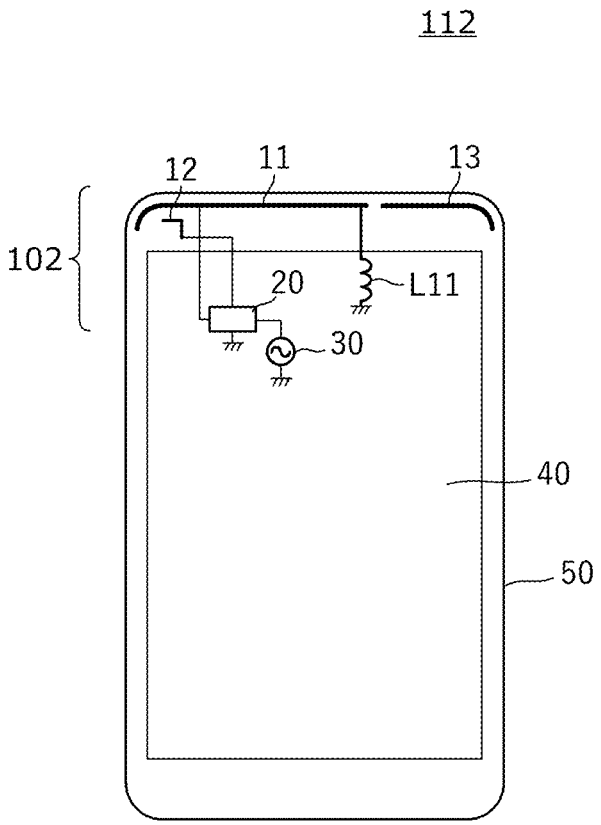
FIG. 6 is a plan view of an antenna device and a communication terminal apparatus including an antenna device according to a preferred embodiment of the present invention.

FIG. 6 is a plan view of an antenna device 102 and a communication terminal apparatus 112 including the antenna device 102. The communication terminal apparatus 112 includes the first radiating element 11, the second radiating element 12, a third radiating element 13, the circuit board 40, and the housing 50.

The feeding circuit 30 is provided at the circuit board 40. Additionally, the antenna coupling element 20 and the inductor L11 are mounted at the circuit board 40.

The first radiating element 11, the second radiating element 12, and the third radiating element 13 are provided as conductor patterns at the resin portion in the housing 50 by using the laser-direct-structuring (LDS) process or the like, for example. The first radiating element 11, the second radiating element 12, and the third radiating element 13 are not limited to this example and may be provided at the circuit board 40 or provided as conductor patterns at a flexible printed circuit (FPC) by employing a photolithography process or the like, for example. In the case in which all the radiating elements are provided inside the housing as described above, the housing 50 may be provided of an insulating member without conductivity, for example, a glass member or a resin member.

The first radiating element connection terminal T1 of the antenna coupling element 20 is coupled to the first radiating element 11 and the second radiating element connection terminal T4 is coupled to the second radiating element 12. The feeding circuit connection terminal T2 is coupled to the feeding circuit 30 and the ground connection terminal T3 is coupled to a ground conductor pattern.

The inductor L11 is coupled between one end of the first radiating element 11 and ground.

The first radiating element 11 defines and functions as a loop antenna in conjunction with the inductor L11 and the ground conductor pattern provided at the circuit board. The second radiating element 12 operates as a monopole antenna. The third radiating element 13 is, for example, a GPS antenna and is coupled to a feeding circuit different from the feeding circuit 30.

Other features, components, and elements are the same as or similar to those of the antenna devices shown in FIGS. 2, 5A, and 5B and other drawings. As described above, the first radiating element 11 may be provided as a conductor pattern.

Figure 7:
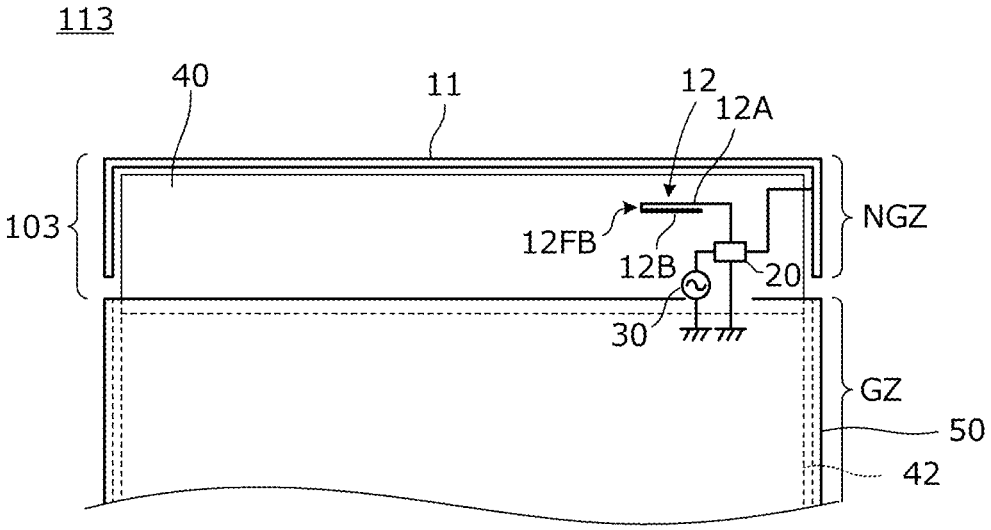
FIG. 7 is a plan view of an antenna device and a communication terminal apparatus including an antenna device according to a preferred embodiment of the present invention.

FIG. 7 is a plan view of an antenna device 103 and a communication terminal apparatus 113 including the antenna device 103. The communication terminal apparatus 113 includes a first radiating element 11, a second radiating element 12, a circuit board 40, and a housing 50.

The first radiating element 11 is provided at a portion of the housing. This portion of the housing is electrically separated from the other portion of the housing. The circuit board 40 includes a ground region GZ in which a ground conductor pattern 42 is provided and a non-ground region NGZ in which the ground conductor pattern 42 is not provided. The second radiating element 12 is provided in the non-ground region NGZ.

The second radiating element 12 is provided as a linear conductor pattern including a folded portion 12FB in a midpoint. Since the second radiating element 12 is provided as a linear conductor pattern including a folded portion in a midpoint as described above, the second radiating element 12 is able to be provided in a reduced space. Moreover, in this example, the second radiating element 12 includes a first linear conductor pattern 12A extending from the antenna coupling element 20 and a second linear conductor pattern 12B provided by folding the second radiating element 12 to the side apart from the first radiating element 11. With this structure, the portion close to the first radiating element 11 is relatively short and the first radiating element 11 and the second radiating element 12 extend in opposite or substantially opposite directions, and thus, actual electric field coupling with the first radiating element 11 is relatively small.

The line width of the second linear conductor pattern 12B is greater than the line width of the first linear conductor pattern 12A, and thus, the resonance band width of the resonance circuit including the second radiating element 12 is able to be widened.

Figure 8:
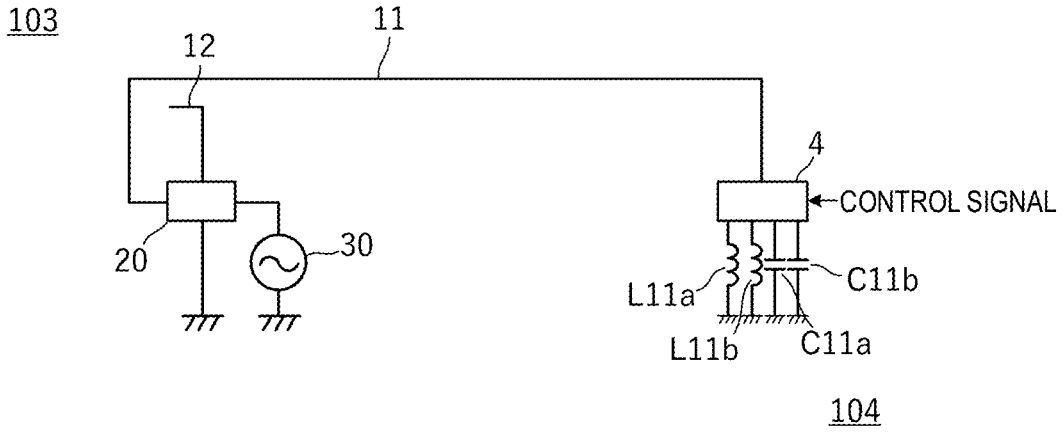
FIG. 8 shows the antenna device of FIG. 7.

FIG. 8 shows the antenna device 103 according to a preferred embodiment of the present invention. The antenna device 103 includes the first radiating element 11, the second radiating element 12, the antenna coupling element 20, inductors Lila and L11*b*, capacitors C11*a* and C11*b*, and a switch 4. The switch 4 selectively connects one of the inductors Lila and L11*b* and the capacitors C11*a* and C11*b* to an end of the first radiating element 11 in accordance with control signals provided from the outside of the antenna device. As a result, the effective length of the antenna is able to be changed by the switch 4.

The inductors Lila and L11*b* have different inductances and the capacitors C11*a* and C11*b* have different capacitances. The resonant frequency of the first radiating element 11 is able to be changed in accordance with a particular one selected from the reactance elements Lila, L11*b*, C11*a* and C11*b*. Other features, components, and elements are the same as or similar to those shown in FIG. 2.

Figure 9:
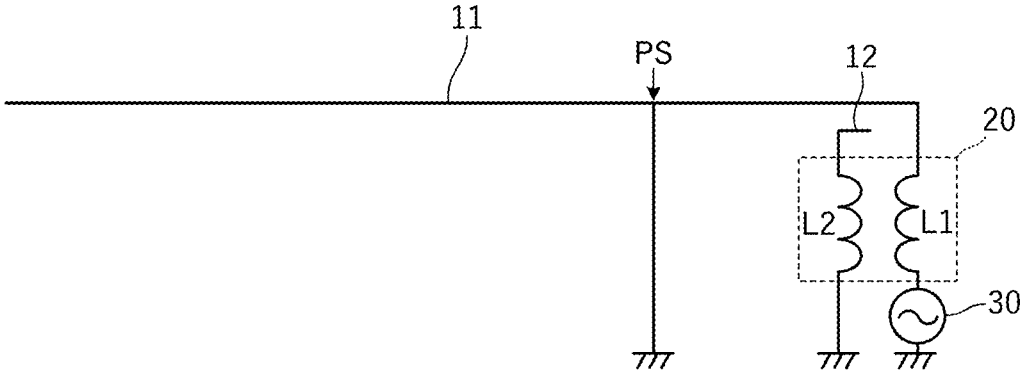
FIG. 9 shows an antenna device according to a preferred embodiment of the present invention.

FIG. 9 shows an antenna device 104 according to a preferred embodiment of the present invention. The antenna device 104 includes the first radiating element 11, the second radiating element 12, and the antenna coupling element 20. The feeding circuit 30 is coupled to a feeding end of the first radiating element 11 via the first coil L1 of the antenna coupling element 20. An end of the first radiating element 11 is open and the first radiating element 11 is grounded at a predetermined grounding position PS in some midpoint. Accordingly, the first radiating element 11 defines and functions as an inverted F antenna. Furthermore, when the first radiating element 11 is a conductor having a planar shape, the first radiating element 11 defines and functions as a planar inverted-F antenna (PIFA). By providing the first radiating element 11 as an inverted F antenna or PIFA as described above, the impedance of the first radiating element 11 is able to be set at the same or approximately the same impedance as the impedance of the feeding circuit, and as a result, impedance matching is able to be easily provided.

The preferred embodiments of the present invention are also able to be applied to an antenna device in which the first radiating element 11 is an inverted F antenna or PIFA.

Figure 10:
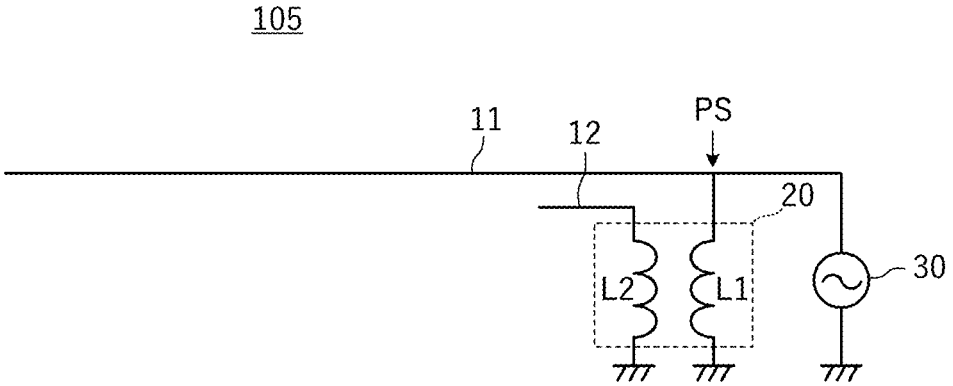
FIG. 10 shows an antenna device according to a preferred embodiment of the present invention.

FIG. 10 shows an antenna device 105 according to a preferred embodiment of the present invention. The antenna device 105 includes the first radiating element 11, the second radiating element 12, and the antenna coupling element 20. The first coil L1 of the antenna coupling element 20 is coupled as a short pin between the grounding position PS of the first radiating element 11 and ground. The second radiating element 12 is coupled to the second coil L2 of the antenna coupling element 20. Accordingly, the first radiating element 11 operates as an inverted F antenna. Furthermore, when the first radiating element 11 is a conductor having a planar shape, the first radiating element 11 defines and functions as a planar inverted-F antenna (PIFA).

The preferred embodiments of the present invention are also able to be applied to an antenna device including an inverted F antenna or PIFA including the features described herein.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a first radiating element;

a second radiating element;

a first coil coupled to one of the first radiating element and a feeding circuit; and a second coil coupled to the second radiating element and coupled to the first coil via an electromagnetic field; wherein the first radiating element and the second radiating element are coupled to each other via an electric field;

the first coil and the second coil define an antenna coupling element; and at a resonant frequency defined by the antenna coupling element and the second radiating element, an absolute value of a phase difference between a current flowing into the second radiating element due to the electromagnetic field of the first coil and the second coil and a current flowing into the second radiating element due to the electric field is equal to or less than about 90 degrees.

2. The antenna device according to claim 1, wherein a second resonant frequency that is a fundamental resonant frequency of the second radiating element and the antenna coupling element is higher than a first resonant frequency that is a fundamental resonant frequency of the first radiating element.

3. The antenna device according to claim 1, wherein a portion of the first radiating element and a portion of the second radiating element are positioned in parallel or substantially in parallel with each other and coupled to each other via the electric field.

4. The antenna device according to claim 1, wherein a magnetic field created by the first coil when a current flows from the first coil to the first radiating element is opposite or substantially opposite in direction to a magnetic field created by the second coil when a current flows from the second coil to the second radiating element.

5. The antenna device according to claim 1, wherein a magnetic field created by the first coil when a current flows from the first coil to the first radiating element is identical or substantially identical in direction to a magnetic field created by the second coil when a current flows from the second coil to the second radiating element.

6. A communication terminal apparatus comprising:

the antenna device according to claim 1; and the feeding circuit; wherein the feeding circuit controls a communication signal in a low band including a resonant frequency of the first radiating element and a communication signal in a high band including the resonant frequency of the antenna coupling element and the second radiating element.

7. The antenna device according to claim 1, wherein the first coil is defined by at least one first conductor pattern provided on a first layer of a substrate; and the second coil is defined by at least one second conductor pattern provided on a second layer of the substrate.

8. The antenna device according to claim 7, wherein the substrate is a multilayer body;

the at least one first conductor pattern is coupled by a first interlayer connection conductor to another first conductor pattern provided on a different layer of the substrate from the at least one first conductor pattern; and the at least one second conductor pattern is coupled by a second interlayer connection conductor to another second conductor pattern provided on a different layer of the substrate from the at least one second conductor pattern.

9. The antenna device according to claim 7, wherein a base material of the substrate is a non-magnetic material.

10. The antenna device according to claim 1, further comprising an inductor that is coupled between one end of the first radiating element and a ground conductor pattern.

11. The antenna device according to claim 10, wherein the first radiating element, the inductor, and the ground conductor pattern define a loop antenna.

12. The antenna device according to claim 1, wherein the second radiating element defines a monopole antenna.

13. The antenna device according to claim 1, wherein the first radiating element resonates in a frequency range of about 0.60 GHz to about 0.96 GHz and a frequency range of about 1.71 GHz to about 2.69 GHz; and the second radiating element resonates in a frequency range of about 1.71 GHz to about 2.69 GHz.

14. The antenna device according to claim 1, further comprising:

at least one capacitor;

at least one inductor; and a switch; wherein the switch selectively couples the at least one capacitor and the at least one inductor to the first radiating element.

15. The antenna device according to claim 14, wherein the at least one capacitor includes a first capacitor and a second capacitor;

the at least one inductor includes a first inductor and a second inductor;

a capacitance of the first capacitor is different from a capacitance of the second capacitor; and an inductance of the first inductor is different from an inductance of the second inductor.

* * * * *